US007162897B2

(12) United States Patent
Ball

(10) Patent No.: US 7,162,897 B2
(45) Date of Patent: Jan. 16, 2007

(54) MANUAL WASHING MACHINE

(76) Inventor: Jonathan Ball, 105 E. Homedale Rd., Caldwell, ID (US) 83607

( * ) Notice: Subject to any disclaimer, the term of this patent is extended or adjusted under 35 U.S.C. 154(b) by 366 days.

(21) Appl. No.: 10/222,708

(22) Filed: Aug. 16, 2002

(65) Prior Publication Data

US 2004/0031296 A1 Feb. 19, 2004

(51) Int. Cl.
*D06F 5/02* (2006.01)

(52) U.S. Cl. ..... 68/215

(58) Field of Classification Search ..... 68/51, 68/122, 129, 130, 215–218; 366/256, 332
See application file for complete search history.

(56) References Cited

U.S. PATENT DOCUMENTS

| | | | | | |
|---|---|---|---|---|---|
| 262,830 | A * | 8/1882 | Rarey | 68/215 |
| 490,372 | A * | 1/1893 | Spangler | 68/215 |
| 523,601 | A * | 7/1894 | Sheehy | 68/213 |
| 597,333 | A * | 1/1898 | Snow | 68/215 |
| 659,296 | A * | 10/1900 | Flesher et al. | 68/215 |
| 879,313 | A * | 2/1908 | Perry et al. | 68/215 |
| 1,085,397 | A * | 1/1914 | Baldwin | 68/215 |
| 1,093,101 | A * | 4/1914 | Beeney et al. | 68/215 |
| 1,099,400 | A * | 6/1914 | Sciarrett | 68/215 |
| 1,100,339 | A * | 6/1914 | Allers | 68/215 |
| 1,114,974 | A * | 10/1914 | Fay | 68/215 |
| 1,150,817 | A * | 8/1915 | Fry | 68/215 |
| 1,163,533 | A * | 12/1915 | Hattersley | 68/215 |
| 1,193,348 | A * | 8/1916 | Bays | 68/215 |
| 1,780,155 | A * | 11/1930 | Hahn | 68/215 |
| 1,930,396 | A * | 10/1933 | Ruppert | 68/215 |
| 3,370,445 | A * | 2/1968 | Lajza | 68/215 |
| 6,341,508 | B1 * | 1/2002 | Minassian | 68/215 |
| 2002/0170323 | A1 * | 11/2002 | Stahl | 68/122 |

OTHER PUBLICATIONS

"Washing Equipment Rapid Washer, AKA Yukon Plunger" http://www.wisementrading.com/washing.htm printed Jul. 11, 2002; 2 Pages.

* cited by examiner

*Primary Examiner*—Joseph L. Perrin
(74) *Attorney, Agent, or Firm*—Robert L. Shaver; Derek H. Maughan; Dykas, Shaver & Nipper, LLP

(57) ABSTRACT

A manual clothes-washing device made up of a handle, which is fastened to a washing body, a sheath and a splash cone. The washing body is a generally concave disc with a plurality of apertures connected to a generally cylindrical tube that extends from a central portion of the disc to a tube end threaded for connection with the handle. The sheath is placed over the washing body and connected to the handle. A splash cone attachment fits over the second end of the sheath. Clothes are washed by alternatively plunging and lifting a portion of the device in a mixture of clothes and liquid to suspend the soil from the clothes within the liquid.

9 Claims, 3 Drawing Sheets

MANUAL WASHING MACHINE

BACKGROUND OF THE INVENTION

1. Field of the Invention

The present invention generally relates to devices for washing clothes and more particularly to a non-electric device for washing clothes.

2. Background Information

Clothes washing is an age-old task required by nearly everyone on the planet Earth. In modernized societies, this activity is generally done by electric powered washing machines wherein clothes are added to a tub along with water and detergent. This mixture is then agitated for a period of time. After this period of time has elapsed, the water is removed from the tub, the clothes are rinsed by agitation for another period of time, the rinse water is then removed and the clothes are removed from the tub to dry.

Most modern washing machines require electricity, are large and not easily stored or transported, and are economically unattainable by a substantial portion of the world's population. These factors preclude their use by a variety of persons for a variety of reasons. For example, the size of these devices coupled with their need for electricity makes these devices unusable by persons such as sportsmen, campers, sailors, individuals involved in relief efforts, people living in third world countries, or other areas where electricity is limited. In addition, the size of most traditional modem clothes washing machines makes them unsuitable for use in small spaces or transportable. Furthermore, the cost of a typical modem washing machine may make obtaining such a machine difficult or impossible for individuals in some countries or economic situations to obtain.

The alternative to the use of modem types of washing machines is to manually wash and rinse the clothes. This process involves wetting the clothes, adding an amount of detergent or other cleaning agent, scrubbing or pounding the clothes against a surface such as a rock or a washboard, rinsing the clothes and repeating the process. This process has several disadvantages. First, clothes that are washed utilizing this process wear more quickly because of the wear and pounding that takes place when they are washed by this method. Second, the hands of the person using the washing board often become raw, bruised or sore as the washboard repeatedly contacts the person's hand. Third, this manual method of washing clothes involves lifting, scrubbing and wringing the clothes and can be very tiring to the person who washes the clothes. This results in manual clothes washing being a wet, tiring chore.

Therefore, what is needed is a clothes-washing device that can wash clothes without electricity in a way that limits damage to the clothes and reduces the amount of associated physical labor. What is also needed is a manual clothes-washing device that enables a person to wash clothes utilizing less water than washing clothes by a manual method. What is further needed is a device that accomplishes these features that is transportable and economically accessible to a wide variety of persons.

Accordingly, it is an object of this invention to provide a non-electric manual washing device that allows the user to wash clothes in a manner that does not significantly damage the clothing being washed and requires less manual effort than washing clothes by traditional methods. An additional object of the invention is to provide such a manual device that is transportable and economically accessible by a wide variety of persons.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In the broadest form, the device of the invention can be a washing body attached to a handle for up and down agitation of clothes in a container with water and soap.

The clothes-washing device of the invention can further include a handle that is connected to a washing body, a sheath and a splash cone by a connection means. The washing body is made up of a generally concave disc having a plurality of apertures. This disc is connected to a generally cylindrical tube that extends from a central portion of the disc to an end that is threaded for connection with the handle. The apertures are dimensioned so that those apertures closest to the tube are smaller than those apertures that are located farthest away from the tube.

The sheath is generally conically shaped and is configured to be placed over the washing body so that one edge of the sheath is adjacent to the outer circumference of the washing body and the other end circumvolves the handle. To accomplish this, the sheath has a first end larger than its second end and a series of holes which penetrate the sheath wall in positions circumvolvingly located near each of the first and second ends of the sheath. A generally conically shaped splash cone attachment may be fitted over the second end of the sheath. The splash cone has a second end configured to circumvolve the handle and is dimensioned to be generally shorter than the cone shaped sheath.

In use, when the washing body and sheath cone are plunged below the surface of a liquid, the liquid passes through the apertures into a chamber defined by the washing body and the conically shaped sheath. Lifting the device from the water causes the liquid to drop from the chamber through the apertures. Repeatedly plunging the device within a container having a desired amount of water and clothes causes the liquid to flow into and out of the chamber and agitates the liquid. The shape of the washing body and the sheath cone create a vacuum effect and pull the liquid through the clothes. The flow of the liquid in and out through the clothes improves the rate at which the clothes can be cleaned or rinsed, while making the washing process fairly easy for the operator.

When clothes are to be washed, they are added to a container such as a tub or bucket. Liquid such as water is then added to the tub or bucket, and a desired type of soap or detergent may also be added. The invented device is then added to the mixture of clothes, water and detergent and alternatively plunged in and out of the water/clothes mixture. This action agitates the mixture of clothes, detergent and water in a manner that cleans the clothes by alternatively pushing and pulling liquid through the clothes. Over a period of time, this action removes soil from the dirty clothes and suspends the soil in the water. When the clothes have achieved a desired level of cleanliness, they are rinsed, removed from the container, wrung out and dried.

This device provides a non-electric clothes-washing device that can wash clothes without electricity in a way that limits damage to the clothes, requires less physical labor and less water than other non-electric washing methods. The device is also configured so as to be relatively lightweight and transportable from one location to another. This device provides all these advantages and can also be manufactured in a way that allows it to be economically affordable to a variety of persons. Additionally, each of the conical components of the device could be made to lie flat until assembly.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
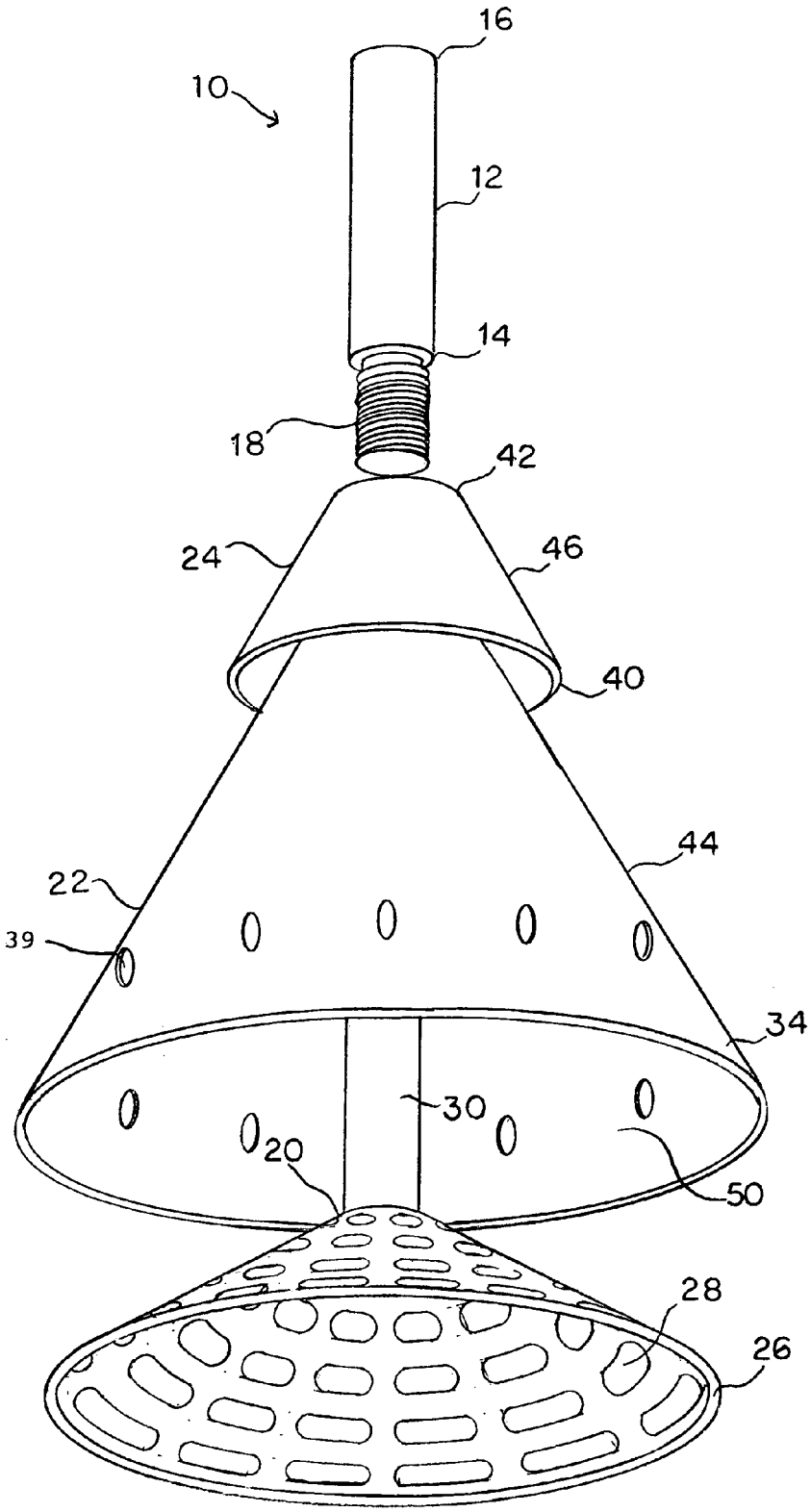
FIG. 1 is a perspective assembly view of a first embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
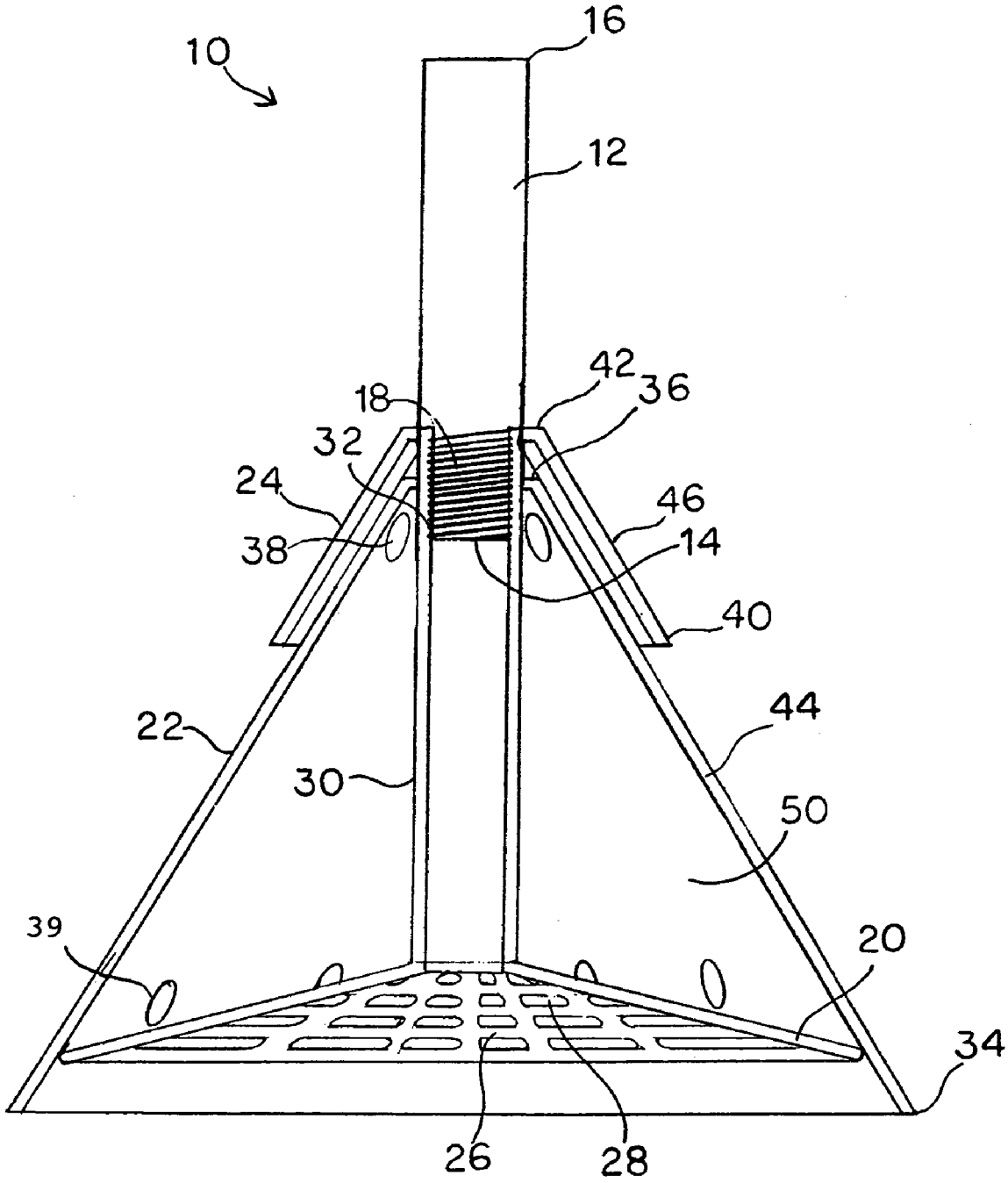
FIG. 2 is a cutaway side view of the embodiment shown in FIG. 1.
Figure 3:
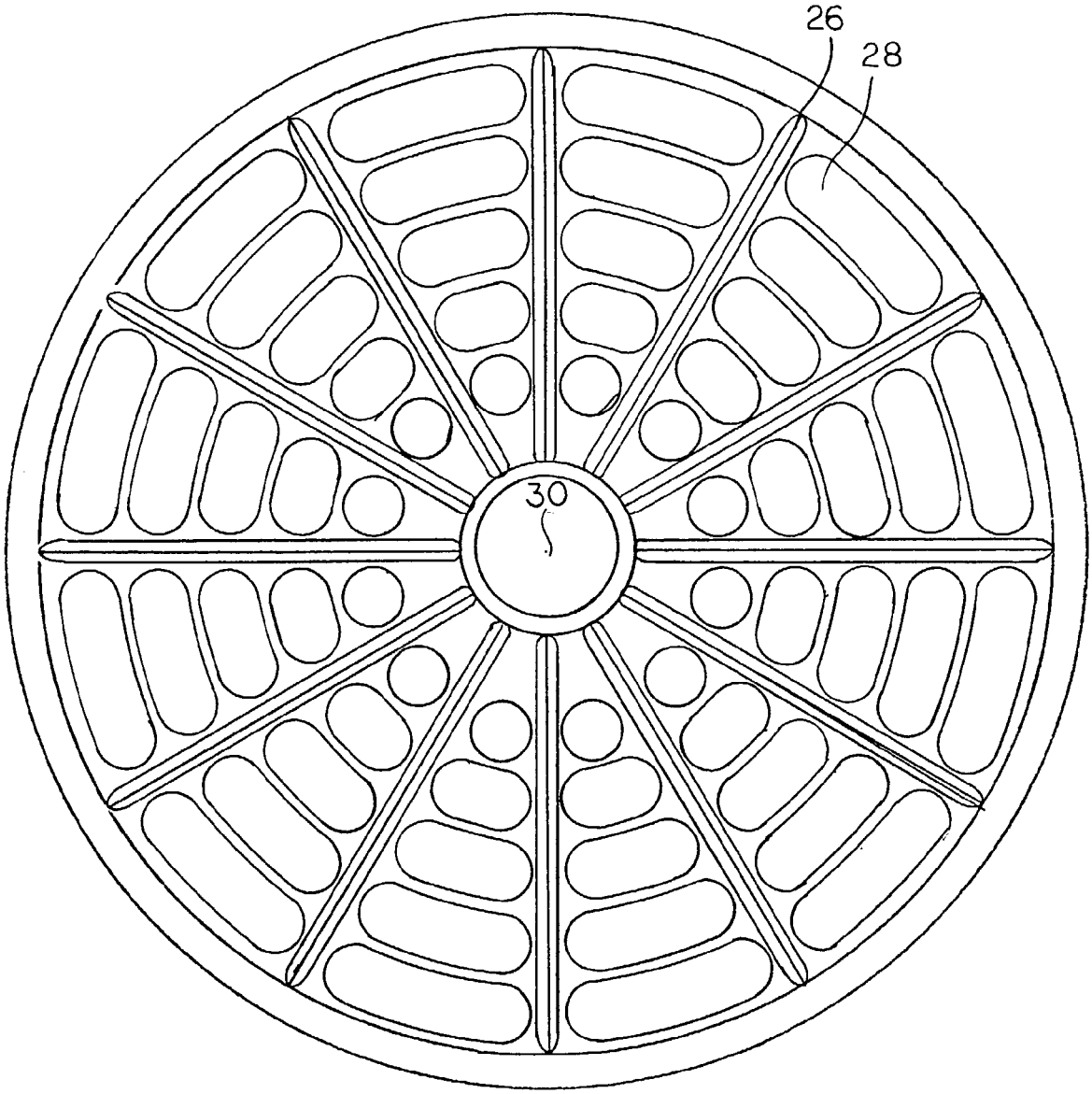
FIG. 3 is a bottom view of the embodiment shown in FIG. 1

A first embodiment of the present invention is shown in FIGS. 1–3.

Referring now to FIG. 1, a perspective assembly view of a first embodiment of the present invention is shown. In this embodiment, a handle 12 having a first end 14 extending to a second end 16 is shown. This handle 12 is connected by a connection means 18 to a washing body 20 that fits within a sheath 22 which in turn fits within a splash cone 24. The washing body 20, the sheath 22 and the splash cone 24 all connect to the handle 12. The washing body 12 is connected by the connection means 18.

While in this embodiment the handle 12 is shown as having a relatively short length, it is to be understood that the length of the handle may be variously modified to accommodate a variety of different requirements dependent upon the application or the person utilizing the device. For example, the handle may be altered to be taller or shorter depending upon whether or not its use is intended to be by a person who is standing or sitting. The configuration of the handle may also be modified to incorporate a variety of grips and grasping and/or gripping means. Likewise, the size of the device can be varied for use in both large and small containers.

In this embodiment, the means for connection 18, which interconnects the handle 12 and the washing body 20, is a threaded connection means. This allows the handle 12 to be alternatively connected and disconnected from the other portions of the device. While a removable type of connection is used in this embodiment, it is to be understood that the device is intended to also be configured for use with a fixed connection means, such as gluing, friction fitting, molding, as well as other conventional forms of adjustable connection. Thus, any means or device which accomplishes the task of maintaining a connection between the handle 12 and the washing body 20 may be used. This connection between the handle 12 and the washing body 20 also acts to hold the sheath 22 and the splash cone 24 in place relative to each other.

The washing body 20 has a generally concave disc shaped strainer 26 with a plurality of apertures 28 defined within it. These apertures 28 are preferably dimensioned so that those apertures 28 located nearest to the handle 12 or the central tube 30 are smaller than those apertures 28 located away from this central tube 30. The tube 30 is used in conjunction with the handle and extends from a generally centrally located portion of the strainer 26 to a tube end (shown in FIG. 2). This tube end is configured to connect with the handle 12 through the connection means 18. While in this embodiment the washing body strainer 26 is a generally concave shaped disc, it is to be understood that any shape may also be used for the strainer 26, the sheath 22 or the splash cone 24 as long as these pieces 20, 22, 24 are configured to interconnect and to perform the desired functions. The shape of the strainer 26 assists in cooperation with the sheath 22 to pull liquid into a chamber 50 formed by the sheath 22 and the strainer portion 26 of the washing body 20.

The sheath 22 is configured to connect about the handle 12 and fits over the washing body 20. This combination of the sheath 22 and the washing body 20 defines a chamber 50. The sheath 22 has a first end 34, which is dimensioned to be generally larger than the second end (shown in FIG. 2) A sheath wall 44 interconnects the first end 34 and the second end (not shown) of the sheath. The sheath wall 44 extends from the first sheath end 34 preferably at an angle of about 60° and has a series of holes 38 located near each of the first 34 and second ends (shown in FIG. 2) The shape of the washing body 20 and the sheath 22 provide a form of suctioning power that forces liquid into the chamber 50 through the apertures 28 of the strainer 26 when the device is plunged into a liquid. The holes 38 located near the second end 36 of the sheath allow for passage of air into and out of the chamber 50 and facilitates a rapid filling of the chamber 50 with liquid.

A splash cone 24 is adapted to interfit with the handle 12 and to cover the holes 38 located near the top end of the sheath 22 (shown in FIG. 2). This sheath cone 24 has a first end 40 extending to a second end 42 along a wall 46. This splash cone 24 is configured to control the splashing of water and material out of the chamber 50 through the holes 38 located near the second end of the sheath cone 36. If the level of the liquid within the chamber 50 rises to the height of the holes located near the second end of the sheath cone 22, the splash cone 24 directs the liquid as it leaves the chamber 50 through the holes 38 downward along the sheath 22.

Referring now to FIG. 2, a cutaway side view of an assembled device 10 is shown. In this figure, the washing body 20, the sheath 22 and the splash cone 24 are all connected to the tube 30 which is connected to the handle 12. The second end 32 of the tube 30 is configured for connection with the connection means 18. The washing body 20 and the tube 30 are covered by a generally conically shaped sheath 22, which has a first end 34 extending to a second end 36 along a wall 44. The second end 36 of the sheath 22 is configured to connect around the handle 12. The sheath 22 and the washing body 20 define a chamber 50, which fills with liquid when the device 10 is submerged or partially submerged within a liquid. The sheath 22 is held in a desired position over the washing body 20 by the connection between the handle 12 and the washing body 20 provided through the connection means 18 and the tube end 32.

The second end 36 of the sheath 22 is covered by a splash cone 24. The splash cone 24 has a first end 40 extending to a second end 42 along a wall 46. The splash cone 24 is connected about the handle 12 near its second end 42. In this embodiment, the wall of the splash cone 46 is configured to be shorter than the wall of the sheath portion 44. While in this embodiment the splash cone 24 is configured to be shorter than the sheath 22, it is to be distinctly understood that this is an illustrative demonstration only and that the length of the splash cone 24 may be variously embodied to meet the necessities or desires of the user.

The connection means 18 attaches the handle 12 to the tube end 32 of the washing body 20. This connection maintains the sheath 22 and the splash cone 24 in a desired position and allows the device 10 to be alternatively lifted and lowered by the handle 12. While in this embodiment all of the pieces connect around the tube 30 and handle 12, it is to be distinctly understood that there are other methods for connecting these pieces together and are also contemplated by this invention.

Referring now to FIG. 3, a bottom view of the invention is shown wherein the disc shaped strainer 26 of the washing body 20 is shown. While in this embodiment these apertures 28 are shown to be generally oval shaped, it is to be understood that the apertures may be any shape including square, circular, etc. Likewise, while in this embodiment the apertures 28 are dimensioned so that those apertures 28 located nearest to the central portion of the disc 26 are smaller than those apertures situated more distant from the center, it is to be understood that the size, shape and configuration of the apertures may be variously embodied to meet the needs of the user.

Referring back to FIG. 2, in use, the washing body 20 and sheath 22 are plunged below the surface of a liquid. Upon initial submersion, liquid is forced through the apertures 28 within the strainer portion 26 of the washing body 20 into the chamber 50 defined by the washing body 20 and the conically shaped sheath 22. If sufficient downward pressure is placed upon the handle 12, the chamber 50 of the device is pushed further into the liquid and liquid rises within the chamber 50 up towards the handle 12. The holes 38 located near the second end 36 of the sheath 22 assist in allowing air to pass out of the chamber 50 and allow this escaping air to be replaced with liquid. When the liquid within the chamber 50 reaches the height of the top holes 38 of the sheath 22, this liquid leaves the chamber 50 through the holes 38 and is directed downward away from the handle 12 by the splash cone 24.

When the device 10 is submersed or partially submersed in a body of liquid, it is then raised by the handle 12 and the liquid within the chamber 50 exits the chamber through the apertures 28 and the holes 39 surrounding the larger first end 34 of the sheath 22. The holes 38 located near the second end 36 of the sheath allow air to enter the chamber 50 and assist to push the liquid out of the chamber through the apertures 28. By alternatively raising and lowering the device 10 within the liquid, liquid enters and exits the chamber 50 through the apertures 28. This action drives water through the clothing, causing the soil in the clothing to be suspended in the liquid. Repeated lifting and lowering of the device 10 suspends a majority of the soil in the liquid and cleans the clothes.

This device 10 can be utilized as a part of a process for washing clothes. In this process, the clothes that are to be washed are added to a container such as a tub or bucket. An amount of liquid, usually water, together with a cleaning agent such as a detergent is then added to the tub or bucket. The exact amount of liquid to be added is dependent upon the exact necessities of the user but an effective amount usually is present when about four inches of water are present within the tub or container. The device is then placed within the mixture of clothes, water and cleaning agent and alternatively lifted and lowered for a period of time. This alternative lifting and lowering action drives water through the clothes and cleans the clothes by releasing soil from the dirty clothes into the water. When the clothes have achieved a desired level of cleanliness, they may be washed in a repeat cycle or rinsed, removed from the container, wrung out and dried.

While in this description the clothes are added first to the tub or container, then the liquid and then the cleaning device, it is to be understood that these steps may be taken in any order depending upon the necessities and preferences of the user of the device.

This device provides a non-electric way of washing clothes in a way that limits damage to the clothes and requires less physical labor and less water than most traditional handwashing methods. This device is also designed in such a way so as to provide these advantages in a way that enables them to be economically affordable to a wide variety of persons.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A manual clothes washing device comprised of:

a handle having a first end extending along a length to a second end a washing body having a generally conically-shaped horizontally oriented body defining therein a plurality of apertures configured to allow passage of a liquid therethrough said apertures arranged in a radiating pattern extending outward from a central tube location, said apertures increasing in size as said apertures extend away from said central tube location;

means for connecting said first end of the handle to said washing body;

a sheath configured for placement about said washing body and having a larger first end, configured for connection about said washing body and a smaller second end configured for connection about said handle, said first end and said second end connected by a wall, said sheath and said washing body defining a chamber;

said sheath further comprising a plurality of openings defined within said sheath circumvolvingly disposed near said first end of said sheath;

said sheath further comprising a plurality of openings defined within said sheath circumvolvingly disposed near said second end of said sheath;

whereby alternatively lifting and lowering said device within a container having a mixture of liquid, clothes and detergent agitates said mixture and washes said clothes.

2. The clothes washing device of claim 1 wherein the apertures located adjacent to said handle are smaller in size than those apertures located distal to said handle;

wherein when said device is plunged below the surface of a liquid, said liquid enters said chamber through said apertures, and wherein lifting said device from within said liquid causes said liquid to leave said chamber through said apertures.

3. The clothes-washing device of claim 1 further comprising a splash cover connected to said handle near said second end of said sheath.

4. The clothes-washing device of claim 3 wherein said sheath and said splash cover are generally frustoconically shaped.

5. The device of claim 3 wherein the distance between a first end of said splash cone and a second end of said splash cone is less than the distance between said first and second ends of said conically shaped sheath.

6. The clothes-washing device of claim 1 wherein said means for connecting said first end of the handle to said washing body comprises threads.

7. A manual clothes-washing device comprised of:

a handle having a first end extending along a length to a second end, said first end configured to connect with a conically shaped sheath, and a splash cone, washing body having a generally concave disc defining a plurality of apertures therein said apertures radially extending outward from a central tube location, said apertures progressively increasing in size as said apertures are positioned further away from said central location;

means for connecting said first end of the handle to said washing body;

said conically shaped sheath having a first end configured for placement about said washing body and a second end configured for attachment about said handle, said sheath also comprising:

a wall;

a plurality of openings defined within said wall circumvolvingly disposed near said first end of said sheath;

a plurality of openings defined within said wall circumvolvingly disposed near said second end of said sheath;

wherein when said device is plunged below the surface of a liquid, the liquid passes through said apertures within said washing body into a chamber defined by said washing body and said conically shaped sheath, and lifting said device from a submersed or partially submersed position within said liquid causes said liquid to fall out of said chamber through said apertures within said washing body;

whereby alternatively lifting and lowering said device within a container having a mixture of liquid, clothes and detergent draws said liquid into and out of said chamber and through said clothes thus agitating said liquid and washing said clothes.

8. The manual clothes washing device of claim 7 further comprising a splash cone attachment having a first end, a second end, and a wall, said splash cone configured to connect about said handle in a position covering said second end of said sheath, said splash cone dimensioned so that the distance between said splash cone attachment first end and said splash cone attachment second end is less than the distance between said first and second ends of said sheath.

9. The manual clothes washing device of claim 7 wherein said washing body further comprises a generally cylindrical tube extending from a central portion of the disc to an end, said end configured to connect with said handle.

* * * * *